US007811643B2

(12) United States Patent
Kim et al.

(10) Patent No.: US 7,811,643 B2
(45) Date of Patent: Oct. 12, 2010

(54) INKJET RECORDING SHEET

(75) Inventors: Kwang Won Kim, Gyeyang-gu (KR); Hong-Soo Lee, Gimpo-si (KR); Kun Young Park, Paju-si (KR)

(73) Assignee: Sang Bo Chemical Limited, Seoul (KR)

( * ) Notice: Subject to any disclaimer, the term of this patent is extended or adjusted under 35 U.S.C. 154(b) by 419 days.

(21) Appl. No.: 11/667,895

(22) PCT Filed: Mar. 9, 2005

(86) PCT No.: PCT/KR2005/000665

§ 371 (c)(1),
(2), (4) Date: Aug. 10, 2007

(87) PCT Pub. No.: WO2006/052050

PCT Pub. Date: May 18, 2006

(65) Prior Publication Data

US 2007/0292638 A1 Dec. 20, 2007

(30) Foreign Application Priority Data

Nov. 15, 2004 (KR) ..... 10-2004-0092910

(51) Int. Cl.
*B41M 5/40* (2006.01)

(52) U.S. Cl. ..... 428/32.18; 428/32.17; 428/32.22; 428/32.28; 428/32.31; 428/32.34

(58) Field of Classification Search ..... 428/32.17, 428/32.18, 32.22, 32.28, 32.31, 32.34
See application file for complete search history.

(56) References Cited

U.S. PATENT DOCUMENTS 5,244,970 A * 9/1993 Kobayashi et al. ..... 525/63
6,365,689 B1 * 4/2002 Ushioda et al. ..... 526/160
6,387,473 B1 5/2002 Sismondi et al.
6,514,660 B1 2/2003 Majumdar et al.
6,610,389 B2 8/2003 Ishimaru et al.
6,613,418 B2 9/2003 Tachikawa et al.
6,764,727 B1 7/2004 Sismondi et al.

OTHER PUBLICATIONS

International Search Report, dated May 30, 2005, Corresponding to PCT/KR2005/000665.

* cited by examiner

*Primary Examiner*—Betelhem Shewareged
(74) *Attorney, Agent, or Firm*—Chrisite, Parker & Hale, LLP

(57) ABSTRACT

Provided is an inkjet recording sheet. The inkjet recording sheet includes a support film comprising homopolypropylene, a propylene-ethylene random copolymer, a propylene-ethylene block copolymer, high-density polyethylene, and polystyrene, a primer layer having larger elongation than the support film and comprising a hydroxyl group-containing polyolefin resin, and an ink absorbing layer. The inkjet recording sheet has substantially the same texture as real photo paper and excellent image quality. When a matte-finish surface is used as a recording surface, a non-glossy treatment effect can be obtained. Therefore, various kinds of consumer's desires can be satisfied. In addition, since the inkjet recording sheet has an appropriate stiffness range, no paper jamming occurs upon continuous printing, substantially the same texture as real photo paper and excellent image quality are ensured. Further, when a matte-finish surface is used as a recording surface, a non-glossy treatment effect can be obtained even when a separate matte paper is not used. In this way, diverse change in an image texture enables to satisfy various kinds of consumer's desires without additional increase of a manufacturing cost.

14 Claims, 1 Drawing Sheet

INKJET RECORDING SHEET

CROSS-REFERENCE TO RELATED APPLICATION

This application is a National Phase Patent Application of International Application Number PCT/KR2005/000665, filed on Mar. 9, 2005, which claims priority of Korean Patent Application Number 10-2004-0092910, filed on Nov. 15, 2004.

FIELD OF THE INVENTION

The present invention relates to an inkjet recording sheet, and more particularly, to an inkjet recording sheet which has substantially the same texture as real photo paper and excellent image quality.

BACKGROUND ART

An inkjet printer is widely used because it has several advantages including a fast print speed, a low cost, and high-resolution image display. In an inkjet recording system, small ink droplets are ejected onto a paper, etc. from one or more nozzles to create characters or images.

Various types of recording sheets, including such as a specially coated sheet of print paper and a print film as well as plain paper, are used for an inkjet printer. Recently, improvement in image quality for an inkjet recording sheet has been rapidly attempted. In particular, with the widespread of digital cameras, image quality comparable to a photographic image and similar texture quality to real photo paper have been required.

Korean Patent No. 10-435294 discloses a recording sheet of paper for inkjet printer in which an additive containing as a main component a cationic resin made by reacting at least secondary amine, ammonia, epihalohydrin, and a crosslinking agent is applied on a surface of or in a sheet of paper. However, such resin coated paper has disadvantages of curling after printing, paper jamming and poor image quality upon continuous printing.

To overcome the problems, there was developed a recording sheet including a hydrophobic support film made of cellulose acetate or polyester such as polyethylene terephthalate and a microporous layer (referred to as "ink absorbing layer", hereinafter) made of inorganic particles and a hydrophilic polymer on the support film. For example, Korean Patent Laid-Open Publication No. 2004-22720 discloses a recording medium for inkjet printer, in which an ink absorbing layer including a binder, a filler, and an ionomer is formed on a surface of a support film selected from a polyester film, a polycarbonate film, and a cellulose acetate film. However, the support film has low stiffness, and thus, the recording medium has a texture different from real photo paper. Further, adhesion between the support film and the ink absorbing layer is poor, and thus, delamination of the ink absorbing layer from the support film may occur.

In this regard, the above patent publication also discloses that an undercoating layer may be selectively formed between the support film and the ink absorbing layer. However, enhancement in adhesion between the ink absorbing layer and the support film is insufficient. Also, in a case where the undercoating layer and the support film are different in elongation, surface cracks may be caused.

Meanwhile, in order to impart a texture to a photo image and to achieve non-glossy coating, a technique of attaching separate matte paper treated with elaborate embossing finish or matte finish to a surface of a recording sheet has been attempted. However, an additional processing step is required to attach matte paper to a surface of a recording sheet, resulting in an increase of a manufacturing cost and degradation of processing efficiency. Further, the use of separate matte paper may deteriorate image quality.

SUMMARY OF THE INVENTION

To solve the above problems, the present invention provides an inkjet recording sheet which has substantially the same texture as real photo paper, exhibits no delamination of an ink absorbing layer from a support film and no paper jamming upon continuous printing, and can impart a texture to a print image even without use of separate matte paper, and thus, can satisfy a wide variety of consumer's desires.

According to an aspect of the present invention, there is provided an inkjet recording sheet including: a support film including homopolypropylene, a propylene-ethylene random copolymer, a propylene-ethylene block copolymer, high-density polyethylene, and polystyrene which have a melt flow index of 1-7, each; a primer layer having larger elongation than the support film and including a hydroxyl group-containing polyolefin resin having a viscosity of 30-100 cP when it is dissolved in a mixed solvent of toluene, ethyl acetate and methyl ethyl ketone into solvent concentration of 3-10%; and an ink absorbing layer.

DETAILED DESCRIPTION

Figure 1:
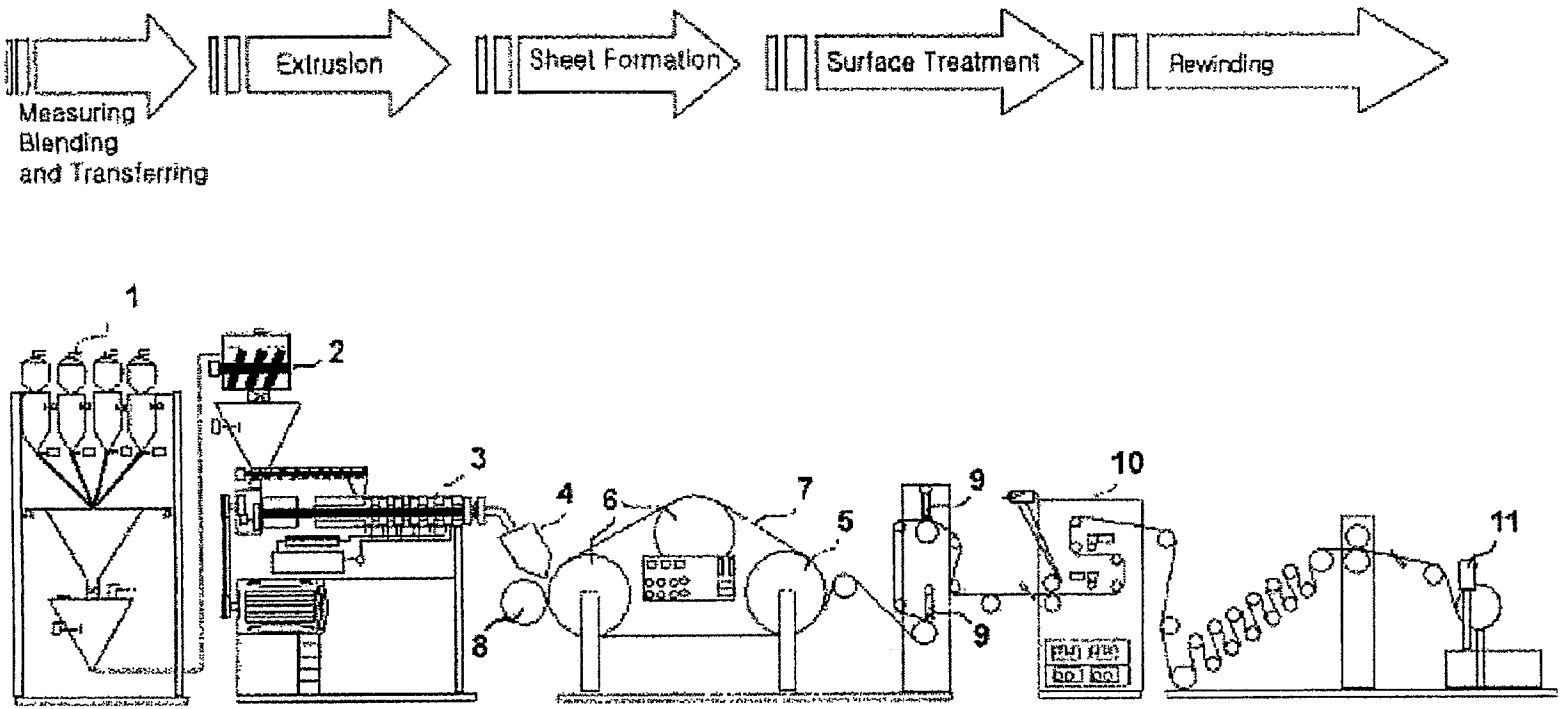
FIG. 1 is a schematic view illustrating an apparatus for producing a support film according to the present invention.

Hereinafter, the present invention will be described in detail.

An inkjet recording sheet according to the present invention has the same texture as real photo paper by appropriately selecting components for a support film, can maintain appropriate stiffness and thus has excellent paper feedability. Further, no paper jamming occurs upon continuous printing and thus workability is excellent. In addition, an inkjet recording sheet according to the present invention includes a primer layer between a support film and an ink absorbing layer to enhance the adhesion between the support film and the ink absorbing layer. The primer layer contains a hydroxyl group-containing polyolefin resin considering its adhesion to both the support film and the ink absorbing layer.

A support film of an inkjet recording sheet according to the present invention includes homopolypropylene, a propylene-ethylene random copolymer, a propylene-ethylene block copolymer, high-density polyethylene (HDPE), and polystyrene which have a melt flow index of 1-7, each. If the melt flow index of each polymer is less than 1, the machining load may be too much, so the formation of film may be difficult. On the other hand, if it exceeds 7, the flowability of the support film formation composition may be too high. Therefore, the thickness control of a support film may be difficult. The homopolypropylene is excellent in crystallinity and tensile strength. The propylene-ethylene random copolymer exhibits enhanced flexibility and transparency, and the propylene-ethylene block copolymer exhibits high impact strength. The high-density polyethylene has a linear structure and serves to increase the stiffness of the support film. The polystyrene has good transparency and gloss and serves to increase stiffness.

The support film may include 5 to 25 parts by weight of a propylene-ethylene random copolymer, 5 to 15 parts by weight of a propylene-ethylene block copolymer, 10 to 15 parts by weight of high-density polyethylene, and 15 to 25 parts by weight of polystyrene, based on 100 parts by weight of homopolypropylene.

If the content of the propylene-ethylene random copolymer is less than 5 parts by weight, a flexible amorphous part of a support film may decrease, whereby damage to appearance is likely to occur even under small impact. On the other hand, if it exceeds 25 parts by weight, an amorphous part of a support film may increase excessively, which may form a very flexible support film.

If the content of the propylene-ethylene block copolymer is less than 5 parts by weight, little enhancement in impact strength may be caused. On the other hand, if it exceeds 15 parts by weight, thermal mixing of a support film composition may be poor and efflorescence after formation of a support film may occur.

If the content of the high-density polyethylene is less than 10 parts by weight, desired stiffness may not be obtained. On the other hand, if it exceeds 25 parts by weight, a high-density polyethylene residue after formation of a support film may appear like a small frame in the machine direction (MD).

If the content of the polystyrene is less than 15 parts by weight, an increase effect in surface gloss may be insufficient. On the other hand, if it exceeds 25 parts by weight, a surface stiffness may increase excessively. Therefore, a support film may be easily broken even when slightly crumpled.

A surface (referred to as "glossy surface," hereinafter) of a support film used in an inkjet recording sheet according to the present invention has a surface smoothness of 98% or more and the other surface (referred to as "matte surface," hereinafter) has a matte finish. When the glossy surface is used as a recording surface, a professional photo image with excellent surface gloss can be obtained. On the other hand, when the matte surface is used as a recording surface, a non-glossy image can be obtained.

As used herein, the phrase "surface smoothness of 98% or more" indicates that when a support film has a thickness of 200 μm, a thickness deviation is 200±2 μm. Meanwhile, it is preferable that the glossy surface has a surface tension of 40 to 48 dyne. If the surface tension of the glossy surface is less than 40 dyne, the adhesion of a coating solution for a primer layer to the glossy surface may decrease so that the coating solution may flow. On the other hand, if it exceeds 48 dyne, a surface smoothness may be lowered. As described above, sequential stacking of a primer layer and an ink absorbing layer on the glossy surface of a support film can provide a recording sheet with excellent surface gloss.

FIG. 1 schematically illustrates an apparatus for producing a support film according to the present invention. A belt line 7 for sheet formation is characteristic in the support film production apparatus. The belt line 7 has a structure surrounding two adjacent driving rolls 6 and a cooling roll 5 disposed at the right side of the driving rolls 6. The belt line 7 is rotatably positioned between a forming roll 8 and the driving roll 6 at the left side in FIG. 1 and can adjust the surface smoothness of a support film.

Referring to FIG. 1, a blender 1 serves to blend materials and a hopper 2 serves to continuously transfer a predetermined amount of a material blend to an extruder 3. The extruder 3 serves to melt the material blend by heating. Preferably, the material blend is melted at a temperature of 210 to 240° C. with rotating at a rate of 100 to 110 rpm. At this time, if the melting temperature is less than 210° C., the melting of the material blend may be insufficient, which renders the physical properties of a support film non-uniform. On the other hand, if it exceeds 240° C., materials may be thermally decomposed, thereby generating carbide. If the rotation speed is less than 100 rpm, thermal conductivity may decrease, and uniform phase change of materials may be difficult to achieve. On the other hand, if it exceeds 110 rpm, a rotary power may be excessively generated. Therefore, the flowability of the molten blend toward a T-die 4 may be poor. Meanwhile, the T-die 4 has a predetermined die gap to produce a product with a desired thickness. The die gap can be adjusted right and left. The thickness of a support film can be adjusted by adjusting the die gap.

According to a method using a conventional cylinder roll, in order to manufacture a support film with a uniform thickness, a polypropylene resin with decreased flowability is pressed using the cylinder roll. Since the pressing is performed against a polypropylene resin with decreased flowability, severe thickness deviation is caused. Further, since the polishing ability of the cylinder roll is poor, there arises a problem of reduction in the surface smoothness of a final support film. On the other hand, according to the present invention, a support film with a very uniform thickness is first manufactured in such a manner that a polypropylene resin with high flowability is allowed to pass through the T-die 4. Then, using the belt line 7 made of metal with excellent surface polishing ability, a surface of the support film contacting with the belt line 7 is polished. Therefore, the surface smoothness of a glossy surface of the support film can be enhanced.

The support film formed to a predetermined thickness in the T-die 4 is allowed to pass through the driving rolls 6 and the forming roll 8. The forming roll 8 is elaborately embossed and thus can impart an embossing or matte finish onto a surface of the support film. The embossing or matte finish can impart a similar texture to paper to the support film or lower the fatigue of the eyes. As described above, sequential stacking of a primer layer and an ink absorbing layer on a matte surface can provide a non-glossy image. When a non-glossy image is desired, an opposite surface to a glossy surface is used as a recording surface. At this time, a back-coating layer including silica particles, etc. may further be formed on the glossy surface so that gloss is appropriately adjusted and a rough texture is imparted to the glossy surface.

Meanwhile, according to the present invention, the shape of a matte surface is not particularly limited provided that it is known in the pertinent art. For example, a matte surface may be in the shape of marble, canvas, artificial leather, lattice, textile, etc. Matte finish using the forming roll 8 does not require a separate matte paper, unlike a common recording sheet, thereby lowering a manufacturing cost of a recording sheet and increasing manufacturing process efficiency. Further, since the forming roll 8 can be replaced with another forming roll with a different surface shape, change in the shape of a matte surface is easy. With respect to a recording sheet with matte finish, an image texture can be changed according to the shape of a matte surface of the recording sheet, which satisfies various kinds of consumer's desires. In this way, when a matte surface is used as a recording surface, a support film may also be manufactured using a common calendaring method.

In the present invention, the surface tension of the support film that has passed through the belt line 7 is adjusted in a corona treatment unit 9. Then, the support film is surface-treated by small powders with very small particle size in a powder treatment unit 10 to prevent surface blocking. Finally, the support film is wound in the form of a roll by a rewinder 11. For example, the powders may be derived from silica, caolin, clay, calcium carbonate, silicon oxide, aluminum oxide, titanium oxide, calcium phosphate, etc.

Preferably, the support film has a thickness of 50 to 350 μm. A support film with the thickness of less than 50 μm is too thin and thus may be deformed upon formation of an ink absorbing layer. Also, the thickness of the ink absorbing layer may be non-uniform. On the other hand, if the thickness of the support film exceeds 350 μm, an inkjet recording sheet is too thick and thus paper jamming may occur.

The support film according to the present invention may include a white pigment, such as titanium dioxide, talc, barium sulfate, calcium carbonate and magnesium oxide. Generally, the white pigment has an average particle size of 0.05 to 0.5 μm, and preferably 0.1 to 0.4 μm. If the average particle size of the white pigment is outside the range, the optical density (OD) of a support film may decrease excessively and a final recording sheet may have an insufficient opacifying effect. Meanwhile, the white pigment is used in an amount of 0.5 to 20 wt %, and preferably 1 to 17 wt %. If the content of the white pigment is less than 0.5 wt %, the optical density of a support film may be low and a final recording sheet may have an insufficient opacifying effect. On the other hand, if the content of the white pigment exceeds 20 wt %, a support film may be easily broken or have a very low mechanical strength. Preferably, the white pigment may be a mixture of titanium dioxide particles with high surface coverage, calcium carbonate and talc. The titanium dioxide particles may have two crystal forms: anatase and rutile. However, anatase titanium dioxide particles are preferable in terms of color and weatherability. Meanwhile, titanium dioxide particles may be surface-treated with oxide of metal such as aluminum, silicon, and zinc, and/or an organic compound, to enhance their dispersibility and weatherability in the support film.

The support film as used herein may further include an antistatic agent, a fluorescent bleaching agent, a colorant, a defoamer, an antioxidant, a UV absorbent, or a quencher, in addition to the above components.

An inkjet recording sheet according to the present invention includes a primer layer including a hydroxyl group-containing polyolefin resin having a viscosity of 30-100 cP when it is dissolved in a mixed solvent of toluene, ethyl acetate and methyl ethyl ketone into solvent concentration of 3-10% to enhance the adhesion between a support film and an ink absorbing layer. The primer layer is essentially non-polar. The primer layer has good adhesion with a support film, and at the same time, has enhanced adhesion with an ink absorbing layer due to the presence of the hydrophilic hydroxyl group. The hydroxyl group can form an urethane bond by crosslinking reaction between it and an isocyanate group as will be described later, thereby enhancing the physical properties of an inkjet recording sheet, including stiffness.

The elongation of the primer layer is higher than that of the support film. Generally, when an ink absorbing layer is finally coated, the support film is slightly elongated by tension. At this time, when the elongation of the primer layer is lower than that of the support film, tiny cracks may be generated on a surface of the primer layer, thereby lowering the image quality of a final recording sheet. Generally, the support film as used herein has an elongation of 3-4% when left stand at 70° C. for 1,000 minutes. In this respect, it is preferable that the elongation of the primer layer exceeds 4%.

Meanwhile, preferably, the hydroxyl group-containing polyolefin resin used in the primer layer of an inkjet recording sheet according to the present invention is an ethylene vinylacetate alcohol copolymer with 20-40 wt % of vinylacetate. The ethylene vinylacetate alcohol copolymer may be prepared by hydrolysis of ethylene vinylacetate copolymer. If the content of the vinylacetate is less than 20 wt %, the adhesion between a primer layer and an ink absorbing layer may worsen. On the other hand, if it exceeds 40 wt %, the adhesion between a primer layer and a support film may worsen and a melting point may be excessively lowered. Meanwhile, degree of hydrolysis of an acetate group in the ethylene vinylacetate is represented by degree of saponification. The physicochemical properties of a polymer vary according to the degree of saponification. In the present invention, it is preferable that the ethylene vinylacetate alcohol copolymer has a degree of saponification of 80-90%. The degree of saponification of less than 80% may lower a solvent resistance, whereas the degree of saponification of above 90% may induce a self-hydrogen bond by a hydroxyl group, thereby lowering the adhesion between a primer layer and an ink absorbing layer. Preferably, the hydroxyl group-containing polyolefin resin is contained in a primer layer formation composition in an amount of 5 to 10 wt %. If the content of the hydroxyl group-containing polyolefin resin is less than 5 wt %, an adhesion effect may be insufficient. On the other hand, if it exceeds 10 wt %, self-reaction may often occur in preparation of a primer layer formation composition and thus coagulation may be caused.

If the viscosity of the primer layer forming composition is less than 30 cP, the surface of the primer layer may be non-uniform, so the adhesion between a primer layer and an ink absorbing layer may be poor. On the other hand, if it exceeds 100 cP, the surface leveling property may be lowered and thus blocking may occur. Meanwhile, the contents of each component in said mixed solvent are not particularly limited provided that it is known in the pertinent art. For example, 5-10 parts by weight of toluene, 40-45 parts by weight of ethylacetate, and 40-45 parts by weight of methylethylketone (MEK) are suitable.

The primer layer according to the present invention may further include a trifunctional isocyanate compound. The trifunctional isocyanate compound is not particularly limited. For example, the trifunctional isocyanate compound may be 1,6,11-undeca triisocyanate, 1,8-diisocyanate-4-isocyanatemethyloctane, or 1,3,6-hexamethylene triisocyanate. The isocyanate compound is crosslinked with the hydroxyl group in the primer layer, thereby enhancing stiffness and preventing curling. Furthermore, the isocyanate compound reacts with a hydroxyl group of polyvinylalcohol in an ink absorbing layer, thereby enhancing adhesion. If the functionality of the isocyanate compound is less than 3, a crosslinking density may be insufficient, and thus, physical properties such as adhesion may be insufficient. On the other hand, if the functionality of the isocyanate compound exceeds 3, a recording sheet may stiffen excessively. Meanwhile, it is preferable that the trifunctional isocyanate compound is used in an amount of 1 to 5 wt %. If the content of the isocyanate compound is less than 1 wt %, a sufficient addition effect may not be obtained. On the other hand, if it exceeds 5 wt %, a recording sheet may stiffen excessively.

According to another embodiment of the present invention, the primer layer may further include silica particles with a particle size of 10 to 500 nm. The silica particles serve to prevent a blocking phenomenon and impart slip property to the surface of the primer layer. If the particle size of the silica particles is less than 10 nm, a surface slip property may be low and thus blocking may occur. On the other hand, if it exceeds 500 nm, a coating surface may be rough and dots may appear upon formation of an ink absorbing layer. Meanwhile, it is preferable to use the silica particles in an amount of 1 to 3 wt %. If the content of the silica particles is less than 1 wt %, a sufficient addition effect may not be obtained. On the other hand, if it exceeds 5 wt %, a considerable ratio of the silica particles may be present on a surface of the primer layer, thereby lowering the adhesion between the primer layer and an ink absorbing layer.

Preferably, the primer layer has a thickness of 0.1-5 μm. If the thickness of the primer layer is less than 0.1 μm, a primer layer formation effect may be insufficient. On the other hand, if it exceeds 5 μm, the silica particles may be buried in the primer layer and thus no addition effect of the silica particles may be obtained.

A composition for formation of the primer layer includes a solvent such as toluene, acetone, and methylethylketone. Generally, the primer layer is formed by gravure coating. The composition for formation of the primer layer may include a sunscreen, an antioxidant, etc. to enhance the light resistance of a recording sheet.

The primer layer may be formed as follows.

First, a coating solution with the above-described composition is prepared. Then, the coating solution is input in a hopper and a support film is allowed to pass through a rubber roll and a copper plate composed of a mesh to perform coating. The copper plate is partially immersed in the coating solution. When mesh cells are sufficiently filled with the coating solution, the support film is surface-treated with a knife so that a predetermined level of coating is formed on the support film. The support film moves in the rotation direction of the mesh. At this time, the support film is pressed by the rubber roll to avoid creation of a gap, thereby allowing only a predetermined extent of coating to be performed over the support film.

An ink absorbing layer used in an inkjet recording sheet according to the present invention may include cationic polyvinylalcohol, an inorganic filler, methanol, dimethylformamide, acetic acid, and water. Among the components for the ink absorbing layer, the cationic polyvinylalcohol is used in an amount of 5 to 15 parts by weight, the inorganic filler in an amount of 10 to 35 parts by weight, the methanol in an amount of 10 to 40 parts by weight, the dimethylformamide in an amount of 10 to 40 parts by weight, and the acetic acid in an amount of 1 to 3 parts by weight, based on 100 parts by weight of water.

The cationic polyvinylalcohol may be polyvinylalcohol in which a branched chain is substituted by quaternary ammonium salt and is used herein as a binder. The cationic polyvinylalcohol may form micropores and thus provides good ink absorption capacity, and has a hydroxyl group and thus can carry a large amount of water-soluble components. Generally, ink is anionic. Thus, the cationic polyvinylalcohol can form an ionic bond with ink. Such an ionic bond allows ink absorbed in the ink absorbing layer to have moisture and heat stability. If the content of the cationic polyvinylalcohol is less than 5 parts by weight, ink absorption capacity may be lowered. Also, adhesion with an alumina sol may be lowered and thus floating of the alumina sol may occur. On the other hand, if it exceeds 15 parts by weight, crosslinking reaction between the polyvinylalcohol and the trifunctional isocyanate compound of the primer layer may increase, and thus, surface stiffness may increase, thereby causing surface cracks.

The weight average molecular weight of the cationic polyvinylalcohol of the invention is preferably 10,000-500,000, and more preferably 50,000-250,000. The reactivity with dye molecules falls if the weight average molecular weight is larger than 500,000, and the water resistance of the record image cannot be increased. Conversely, if the weight average molecular weight is less than 10,000, the reactivity with dye molecules increases too much, so when the resin comes in contact with ink, it reacts rapidly with the dye molecules in the ink to produce a precipitate, and in this case, the ink absorptivity of the recording medium falls.

Meanwhile, the inorganic filler serves to enhance the ink absorption capacity of the ink absorbing layer and to compensate for fixing property of a dye. The inorganic filler also serves to prevent blocking between films that may be caused by the use of the binder alone and to enhance gloss. The inorganic filler is not particularly limited provided that it is commonly used in the pertinent art. However, an alumina sol or a silica sol is preferable. Preferably, the inorganic filler has a particle size of 30 to 200 nm. As the particle size of the inorganic filler decreases, gloss increases but ink absorption capacity decreases. If the particle size of the inorganic filler is too large, both gloss and transparency may be lowered. Meanwhile, if the content of the inorganic filler is less than 10 parts by weight, a sufficient addition effect may not be obtained. On the other hand, if it exceeds 35 parts by weight, the inorganic filler may be agglomerated on a surface of the ink absorbing layer, thereby forming small granules.

The methanol contained in the ink absorbing layer according to the present invention is used as a solvent. The methanol serves to decrease surface tension and enhance surface leveling property. Meanwhile, the dimethylformamide serves to increase the stability of a coating solution and prevent surface cracks due to its high boiling point of about 333° C. If the content of the methanol is less than 10 parts by weight, a leveling property may not be maintained, and thus a rainbow phenomenon may appear. Also, a coating thickness may be partially non-uniform. On the other hand, if it exceeds 40 parts by weight, a surface leveling property may be lowered and ink absorption capacity may also be lowered.

If the content of the dimethylformamide is less than 10 parts by weight, a sufficient addition effect may not be obtained. On the other hand, if it exceeds 40 parts by weight, the dimethylformamide may be incompletely dried. Therefore, a smell may be emitted from a final product and a surface of the ink absorbing layer may be stained.

Meanwhile, the acetic acid used in the ink absorbing layer according to the present invention serves to increase the surface stability of alumina. In detail, the acetic acid provides negative charges to a surface of alumina, thereby enhancing dispersibility of alumina by repulsion of particles. If the content of the acetic acid is less than 1 part by weight, a sufficient addition effect may not be obtained. On the other hand, if it exceeds 3 parts by weight, a strong sour smell may be emitted from a final product.

A composition for formation of the ink absorbing layer may further include additives such as a crosslinking agent, a fixing agent, a dye, a fluorescent dye, a light diffuser, a pH modifier, an antioxidant, a leveling agent, a defoamer or a deaerator, a lubricant, and an anticurling agent, to supplement the physical properties of the ink absorbing layer.

Preferably, the ink absorbing layer according to the present invention has a thickness of 15 to 60 μM. If the thickness of the ink absorbing layer is less than 15 μm, ink absorption capacity may be lowered and thus 100% ink absorption after printing may not be achieved, thereby causing ink blurring. On the other hand, if it exceeds 60 μm, ink absorption capacity is not affected but the thickness of the ink absorbing layer is too thick, and thus, surface breakage may be caused.

The leveling agent is used to enhance the surface smoothness of the ink absorbing layer. A surfactant may be used as the leveling agent. Preferably, the leveling agent is used in an amount of 2 to 5 parts by weight, based on 100 parts by weight of the composition for formation of the ink absorbing layer. If the content of the leveling agent is less than 2 parts by weight, a sufficient addition effect may not be obtained. On the other hand, if it exceeds 5 parts by weight, surface gloss may be lowered.

The crosslinking agent serves to increase water resistance and surface strength by crosslinking reaction between a binder component and a filler component. For example, the crosslinking agent may be oxazoline, isocyanate, epoxide, aziridine, melamine-formaldehyde, dialdehyde, boron compound, or a mixture thereof.

The ink absorbing layer may be formed by a known coating method, for example, dip coating, lip coating, comma coating, die coating, or gravure coating.

Meanwhile, a back-coating layer may be further formed on an opposite surface to a recording surface of an inkjet recording sheet according to the present invention to enhance continuous paper feedability and prevent paper curling. The back-coating layer may be formed using a binder selected from polyvinylalcohol used for the ink absorbing layer; and a blend of a polymer such as methyl cellulose, hydroxypropylmethyl cellulose, gelatin, polyethyleneoxide, acrylic polymer, polyester, and polyurethane and a crosslinking agent such as an isocyanate compound. To impart roughness to a surface of the back-coating layer, silica particles, a polymethylmethacrylate (PMMA) bead, etc. may be used in an amount of 0.5 to 10 parts by weight, based on 100 parts by weight of the binder. Meanwhile, to embody colors on the back-coating layer, a common light resistance dye may be used. When a back-coating composition containing the above components is coated to a thickness of about 1 to 20 μm (on dry basis) by dip coating, lip coating, comma coating, die coating, or gravure coating, the curling phenomenon of a final product is prevented and continuous paper feedability is enhanced.

A top coating layer may be further formed on top of a recording surface of an inkjet recording sheet according to the present invention to protect the ink absorbing layer. Since the surface strength of the ink absorbing layer is slightly lower than that of the support film, a transfer mark may remain on the ink absorbing layer by a guide roll upon printing according to the type of a printer. In this respect, the top coating layer is used to enhance a transfer property, and thus, to prevent the formation of a transfer mark. A composition for formation of the top coating layer includes polyvinylalcohol as a binder, methanol and water as a solvent, and nano-scale organic/inorganic particles. The organic/inorganic particles may be silica particles, modified silica particles, polysiloxane particles, polymethylmethacrylate particles, etc. Preferably, the organic/inorganic particles are used in an amount of 0.01 to 5 parts by weight, based on 100 parts by weight of the solvent. If the content of the organic/inorganic particles is less than 0.01 parts by weight, enhancement in transfer property may be insufficient. On the other hand, if it exceeds 5 parts by weight, initial slip property may be excessive. Therefore, failure to initial paper grasping in a transfer unit of a printer may occur. Meanwhile, it is preferable that the polyvinylalcohol as a binder is used in an amount of 0.05 to 1 part by weight, based on 100 parts by weight of the solvent. If the content of the polyvinylalcohol is less than 0.05 parts by weight, fixation of the organic/inorganic particles in the top coating layer may be lowered. On the other hand, if it exceeds 1 part by weight, the organic/inorganic particles may be covered with the polyvinylalcohol, thereby remarkably decreasing surface slip property. Meanwhile, it is preferable that the methanol as a solvent is used in an amount of 70 to 100 parts by weight, based on 100 parts by weight of water. If the content of the methanol is less than 70 parts by weight, a leveling property upon coating may worsen, thereby causing partially non-uniform coating. If it exceeds 100 parts by weight, excess methanol may be absorbed in the ink absorbing layer upon coating, and thus increase in local surface stiffness of the ink absorbing layer may be caused, leading to partial reduction in ink absorption capacity. When a composition for formation of the top coating layer is coated to a thickness of 0.05 to 0.5 μm (on dry basis) by dip coating, lip coating, comma coating, die coating, or gravure coating, scratch formation by a printer upon printing can be prevented.

As used herein, the term "stiffness" indicates "bending stiffness." Generally, stiffness is generally represented by the product of modulus of elasticity and secondary moment. However, stiffness may vary even in the same material because it depends on a sectional shape of a material. With respect to stiffness of a recording sheet according to the present invention, on the basis of 200 g/cm$^2$ weight paper, the MD (machine direction) stiffness is in the range of 800 to 1,000 mg and the CD (cross direction) stiffness is in the range of 500 to 700 mg (Gurley type stiffness tester). Based on the same weight paper, the stiffness of a recording sheet of the present invention is larger than that of a common print paper made of polypropylene and smaller than that of a common resin coated paper. In this way, a recording sheet according to the present invention has an appropriate stiffness range, thereby providing good paper feedability, and exhibits no paper jamming upon continuous printing, thereby providing good workability.

An inkjet recording sheet according to the present invention has good adhesion between a support film and an ink absorbing layer and thus can prevent delamination of the ink absorbing layer from the support film. Further, the inkjet recording sheet has an appropriate stiffness range. Therefore, no paper jamming occurs upon continuous printing, substantially the same texture as real photo paper and excellent image quality are ensured. In addition, when a matte-finish surface is used as a recording surface, a non-glossy treatment effect can be obtained even when a separate matte paper is not used. In this way, diverse change in an image texture enables to satisfy various kinds of consumer's desires.

Hereinafter, the present invention will be described more specifically by Examples. However, the following Examples are provided only for illustrations and thus the present invention is not limited to or by them.

EXAMPLE 1

1-(1): Preparation of Support Film 40 parts by weight of polypropylene (H221P, SK Corp., Korea), 15 parts by weight of a propylene-ethylene random copolymer (R930Y, SK Corp., Korea), 10 parts by weight of a propylene-ethylene block copolymer (FT210, SK Corp., Korea), 10 parts by weight of $TiO_2$ with an average particle size of 0.5 μm, 3 parts by weight of $CaCO_3$, 2 parts by weight of talc, 9 parts by weight of high-density polyethylene, and 11 parts by weight of polystyrene were uniformly mixed in a blender and transferred to a hopper. A predetermined amount of a material blend was continuously transferred to an extruder from the hopper and then heated to about 210° C. with rotating at a rate of about 100 rpm in the extruder. The resultant molten blend was transferred to a T-die and ejected to a thickness of 200 μm by the T-die. The resultant ejection was allowed to pass between a forming roll with a canvas matte finish and a driving roll by a belt line. Then, the resultant film was cooled by a cooling roll, subjected to a post-treatment process of a corona treatment at a voltage of about 9,000V and a powder treatment, and rewound under a tension of 5 kgf, to prepare a support film in the form of a roll. Finally obtained support film had a thickness of 200 μl, a surface smoothness (for glossy surface) of 98%, and a surface tension of 40 dyne.

1-(2): Formation of Primer Layer 200 ml of ethylalcohol and 0.5 g of sodium metal were placed in a flask and 10 g of vinylacetate copolymer (Elvax 250, Dupont) with 28 wt % of vinylacetate was added thereto. The reaction mixture was refluxed for 6 hours, neutralized with 5% HCl solution, and washed with water and alcohol, to obtain a vinylacetate alcohol copolymer with degree of saponification of 90%. 6 parts by weight of the vinylacetate alcohol copolymer, 0.5 parts by weight of silica with a particle size of 50 nm, and 1.5 parts by weight of isocyanate (Coronate HX, Nippon Polyurethane Industry Co., Ltd.) were dissolved in a mixed solvent of 7 parts by weight of toluene, 43 parts by weight of ethylacetate, and 42 parts by weight of methylethylketone (MEK) to prepare a coating solution having a viscosity of 50 cP. Then, the coating solution was placed in a hopper, applied onto a glossy surface of the support film prepared in Example 1-(1) by a common gravure coating method using #175 mesh, and dried at 50° C., to form a primer layer with a thickness of 0.5 μm.

1-(3): Formation of Ink Absorbing Layer 15 parts by weight of aluminum isopropyl oxide with an average particle size of 100 nm, 5 parts by weight of cationic polyvinylalcohol (PVA) (Gohsefimer K, Nippon Gohsei), and 3 parts by weight of acetic acid were dissolved in a mixed solvent of 14 parts by weight of methanol, 10 parts by weight of dimethylformamide (DMF), and 50 parts by weight of water and mixed with a homo-mixer to obtain a coating solution. Then, the coating solution was input in a hopper by a gear pump and applied onto the primer layer formed in Example 1-(2) by dip coating to form an ink absorbing layer with a thickness of 30 μm.

EXAMPLE 2

2-(1): Preparation of Support Film

A support film was prepared in the form of a roll in the same manner as in Example 1-(1) except that the high-density polyethylene was used in an amount of 7 parts by weight, an ejection thickness was 230 μm by adjusting the gap of the T-die, and the corona treatment was performed at a voltage of 10,000V. The support film had a surface smoothness (for glossy surface) of 98% and a surface tension of 44 dyne.

2-(2): Formation of Primer Layer

A primer layer was formed in the same manner as in Example 1-(2) except that the thickness of the primer layer was adjusted to 3 μm using a knife.

2-(3): Formation of Ink Absorbing Layer

An ink absorbing layer was formed to a thickness of 40 μmin the same manner as in Example 1-(3).

2-(4): Formation of Back-Coating Layer

A back-coating layer was formed on an opposite surface to the glossy surface to prevent curling. The back-coating layer was formed as follows: 5 parts by weight of silica particles with an average particle size of 100 nm were added to 100 parts by weight of a binder resin containing an acrylic polymer with Tg of 120° C. and an isocyanate based crosslinking agent (Coronate HX, Nippon Polyurethane Industry Co., Ltd.) and the reaction mixture was coated to a thickness of 10 μm (on dry basis) on the opposite surface to the glossy surface of the support film by gravure coating.

EXAMPLE 3

A recording sheet was manufactured in the same manner as in Example 1 except that a primer layer and an ink absorbing layer were sequentially coated on a canvas matte surface and then a top coating layer was formed on the ink absorbing layer. The top coating layer was formed to a thickness of 0.1 μm (on dry basis) by gravure coating using a mixed solution containing 3 parts by weight of silica particles with a particle size of 30 nm, 0.5 parts by weight of PVA (PVA 217, Kuraray), 50 parts by weight of water, and 50 parts by weight of methanol.

EXPERIMENTAL EXAMPLE 1

Surface gloss, the adhesion between a support film and an ink absorbing layer, the incidence of paper jamming, and the degree of scratch on a print surface were evaluated and the results are presented in Table 1 below.

Surface gloss was measured according to ASTM D2457 at an angle of 60°. Meanwhile, the adhesion between a support film and an ink absorbing layer was measured according to ASTM D3359-93. At this time, Sekisui tape (Japan) was used.

The incidence of paper jamming was evaluated using Epson 1290 model (1440 DPI) by continuously feeding ten sheets of paper. The degree of scratch on a print surface was evaluated by visual observation.

TABLE 1

| Sample | Surface gloss | Adhesion between support film and ink absorbing layer | Paper jamming | Degree of scratch on print surface |
|---|---|---|---|---|
| Example 1 | 63% | Good | No detection | ○ |
| Example 2 | 52% | Good | No detection | ○ |
| Example 3 | 20% | Good | No detection | ◎ |

◎: excellent (no scratch), ○: good (little scratch)

◎: excellent (no scratch), ○: good (little scratch)

The recording sheet manufactured in Example 3 had a recording surface with a marble matte finish and thus could provide a surface gloss of 20% for the recording surface and a delicate non-glossy image on the recording surface.

INDUSTRIAL APPLICABILITY

As apparent from the above description, an inkjet recording sheet according to the present invention has substantially the same texture as real photo paper and excellent image quality is ensured. In addition, when a matte-finish surface is used as a recording surface, diverse change in an image texture enables to satisfy various kinds of consumer's desires without additional increase of a manufacturing cost.

The invention claimed is:

1. An inkjet recording sheet comprising:

a support film comprising homopolypropylene, a propylene-ethylene random copolymer, a propylene-ethylene block copolymer, high-density polyethylene, and polystyrene which have a melt flow index of 1-7, each;

a primer layer having larger elongation than the support film and comprising a hydroxyl group-containing polyolefin resin having a viscosity of 30-100 cP when it is dissolved in a mixed solvent of toluene, ethyl acetate and methyl ethyl ketone into solvent concentration of 3-10%; and an ink absorbing layer.

2. The inkjet recording sheet of claim 1, wherein the support film comprises 5-25 parts by weight of the propylene-ethylene random copolymer, 5-15 parts by weight of the propylene-ethylene block copolymer, 10-15 parts by weight of the high-density polyethylene, and 15-25 parts by weight of the polystyrene, based on 100 parts by weight of the homopolypropylene.

3. The inkjet recording sheet of claim 1, wherein a surface of the support film has a surface smoothness of 98% or more and a surface tension of 40-48 dyne, and the primer layer and the ink absorbing layer are sequentially stacked on the surface of the support film.

4. The inkjet recording sheet of claim 1, wherein a surface of the support film has a matte finish and the primer layer and the ink absorbing layer are sequentially stacked on the surface of the support film, so that the inkjet recording sheet exhibits various image textures according to the shape of the matte-finish surface.

5. The inkjet recording sheet of claim 1, wherein the hydroxyl group-containing polyolefin resin is an ethylene vinylacetate alcohol copolymer with 20 to 40 wt % of vinylacetate.

6. The inkjet recording sheet of claim 5, wherein degree of saponification of the ethylene vinylacetate alcohol copolymer is 80 to 90%.

7. The inkjet recording sheet of claim 1, wherein the primer layer further comprises a trifunctional isocyanate compound.

8. The inkjet recording sheet of claim 1, wherein the primer layer further comprises silica particles with a particle size of 10 to 500 nm.

9. The inkjet recording sheet of claim 1, wherein the primer layer has a thickness of 0.1 to 5 μm.

10. The inkjet recording sheet of claim 1, wherein the ink absorbing layer comprises cationic polyvinylalcohol, an inorganic filler, methanol, dimethylformamide, and acetic acid.

11. The inkjet recording sheet of claim 10, wherein the ink absorbing layer has a thickness of 15 to 60 μm.

12. The inkjet recording sheet of claim 10, wherein the ink absorbing layer further comprises a leveling agent, and the leveling agent is used in an amount of 25 parts by weight, based on 100 parts by weight of a composition for the ink absorbing layer.

13. The inkjet recording sheet of claim 1, further comprising a back-coating layer.

14. The inkjet recording sheet of claim 1, further comprising a top coating layer.

* * * * *